US006510907B1

(12) United States Patent
Blange

(10) Patent No.: US 6,510,907 B1
(45) Date of Patent: Jan. 28, 2003

(54) ABRASIVE JET DRILLING ASSEMBLY

(75) Inventor: Jan Jette Blange, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/561,849

(22) Filed: Apr. 28, 2000

(30) Foreign Application Priority Data

Apr. 28, 1999 (EP) ..... 99303307

(51) Int. Cl.[7] ..... E21B 43/114

(52) U.S. Cl. ..... 175/67; 175/393; 175/424; 451/87

(58) Field of Search ..... 175/67, 54, 424, 175/393; 451/75, 87, 102; 239/424, 403, 336; 299/17

(56) References Cited

U.S. PATENT DOCUMENTS

| | | | | |
|---|---|---|---|---|
| 3,212,217 A | * | 10/1965 | Furgason | 239/424 X |
| 3,838,742 A | | 10/1974 | Juvkam-Wold | |
| 3,854,997 A | * | 12/1974 | Peck et al. | 175/14 X |
| 4,042,048 A | | 8/1977 | Schwabe | |
| 4,478,368 A | * | 10/1984 | Yie | 451/102 X |
| 4,534,427 A | | 8/1985 | Wang et al. | |
| 4,666,083 A | * | 5/1987 | Yie | 239/8 |
| 4,688,650 A | | 8/1987 | Hayatdavoudi et al. | |
| 4,708,214 A | * | 11/1987 | Krawza et al. | 175/424 |
| 4,768,709 A | * | 9/1988 | Yie | 239/336 X |
| 4,872,293 A | * | 10/1989 | Yasukawa et al. | 451/75 |
| 5,018,317 A | * | 5/1991 | Kiyoshige et al. | 451/102 |
| 5,098,164 A | * | 3/1992 | Savanick et al. | 299/17 |
| 5,575,705 A | * | 11/1996 | Yam et al. | 451/39 |

FOREIGN PATENT DOCUMENTS

| | | | | |
|---|---|---|---|---|
| GB | 2095722 | * | 10/1982 | 299/17 |
| GB | 2206508 | | 1/1989 | |
| JP | 444594 | * | 2/1992 | 175/67 |
| WO | 9817439 | * | 4/1998 | |
| WO | 9922112 | | 5/1999 | |
| WO | 66872 | * | 11/2000 | |

OTHER PUBLICATIONS

Search Report dated Jul. 19, 2000 (PCT/EP00/04180).

* cited by examiner

*Primary Examiner*—Jong-Suk (James) Lee

(57) ABSTRACT

A drilling assembly for drilling a borehole into an earth formation is disclosed having a drill string extending into the borehole and a jetting device arranged at a lower part of the drill string, the jetting device is provided with a mixing chamber having a first inlet in fluid communication with a drilling fluid supply conduit, a second inlet for abrasive particles and an outlet which is in fluid communication with a jetting nozzle arranged to jet a stream of abrasive particles and drilling fluid against at least one of the borehole bottom and the borehole wall. The jetting device is further provided with an abrasive particles recirculation system for separating the abrasive particles from the drilling fluid at a selected location where the stream flows from the at least one of the borehole bottom and the borehole wall towards the upper end of the borehole and for supplying the separated abrasive particles to the second inlet.

28 Claims, 4 Drawing Sheets

ABRASIVE JET DRILLING ASSEMBLY

BACKGROUND OF THE INVENTION

The present invention relates to a drilling assembly for drilling a borehole into an earth formation, comprising a drill string extending into the borehole and a jetting device arranged at the lower end of the drill string. The jetting device ejects a high velocity stream of drilling fluid against the rock formation so as to erode the rock and thereby to drill the borehole. In order to improve the rate of penetration of the drill string it has been proposed to mix abrasive particles into the jet stream.

One such system is disclosed in U.S. Pat. No. 3,838,742 wherein a drill string is provided with a drill bit having a number of outlet nozzles. Drilling fluid containing abrasive particles is pumped via the drill string through the nozzles to produce high velocity jets impacting against the borehole bottom. The abrasive particles accelerate the erosion process compared to jetting of drilling fluid only. The rock cuttings are entrained into the stream which returns through the annular space between the drill string and the borehole wall to surface. After removal of the rock cuttings from the stream, the pumping cycle is repeated. A drawback of the known system is that continuous circulation of the abrasive particles through the pumping equipment and the drill string leads to accelerated wear of these components. Another drawback of the known system is that constraints are imposed on the rheological properties of the drilling fluid, for example a relatively high viscosity is required for the fluid to transport the abrasive particles upwardly through the annular space.

It is an object of the invention to provide an improved drilling assembly for drilling a borehole into an earth formation, which overcomes the drawbacks of the known system and which provides an increased rate of penetration without accelerated wear of the drilling assembly components.

SUMMARY OF THE INVENTION

In accordance with the invention there is provided a drilling assembly for drilling a borehole into an earth formation, comprising a drill string extending into the borehole and a jetting device arranged at a lower part of the drill string, the jetting device being provided with a mixing chamber having a first inlet in fluid communication with a drilling fluid supply conduit, a second inlet for abrasive particles and an outlet which is in fluid communication with a jetting nozzle arranged to jet a stream of abrasive particles and drilling fluid against at least one of the borehole bottom and the borehole wall, the jetting device further being provided with an abrasive particles recirculation system for separating the abrasive particles from the drilling fluid at a selected location where the stream flows from said at least one of the borehole bottom and the borehole wall towards the upper end of the borehole and for supplying the separated abrasive particles to the second inlet.

The abrasive particle recirculation system separates the abrasive particles from the stream after impact of the stream against the rock formation, and returns the abrasive particles to the mixing chamber. The remainder of the stream which is, apart from the drill cuttings, substantially free of abrasive particles, returns to surface and is recycled through the drilling assembly after removal of the drill cuttings. It is thereby achieved that the abrasive particles circulate through the lower part of the drilling assembly only while the drilling fluid which is substantially free of abrasive particles circulates through the pumping equipment, and that no constraints are imposed on the rheological properties of the drilling fluid regarding transportation of the abrasive particles to surface.

Suitably the recirculation system includes means for creating a magnetic field in the stream, and the abrasive particles include a material subjected to magnetic forces induced by the magnetic field, the magnetic field being generated such that the abrasive particles are separated from the drilling fluid by said magnetic forces. The means for creating the magnetic field comprises, for example, at least one magnet.

In a preferred embodiment, the drill string is at the lower end thereof provided with a drill bit, and the jetting nozzle is arranged to jet the stream of abrasive particles and drilling fluid against the wall of the borehole as drilled by the drill bit so as to enlarge the borehole diameter to a diameter significantly larger than the diameter of the drill bit. By drilling the borehole using the drill bit and enlarging the borehole diameter to a diameter significantly larger than the diameter of the drill bit, a tubular such as a casing or a liner can be installed in the borehole while the drill string is still present in the borehole. The drill string and drill bit can thereafter be retrieved to surface through the tubular.

The tubular to be installed in the borehole can be formed by the drill string, in which case the drill string has an inner diameter larger than the outer diameter of the drill bit, the drill bit being detachable from the drill string and being provided with means for detaching the drill bit from the drill string and for retrieving the drill bit through the drill string to surface.

BRIEF DESCRIPTION OF THE DRAWINGS

The invention will be described hereinafter in more detail and by way of example, with reference to the accompanying drawings in which FIG. 1 schematically shows a longitudinal cross-section of an embodiment of the drilling assembly according to the invention.

DETAILED DESCRIPTION OF PREFERRED EMBODIMENTS

Figure 1:
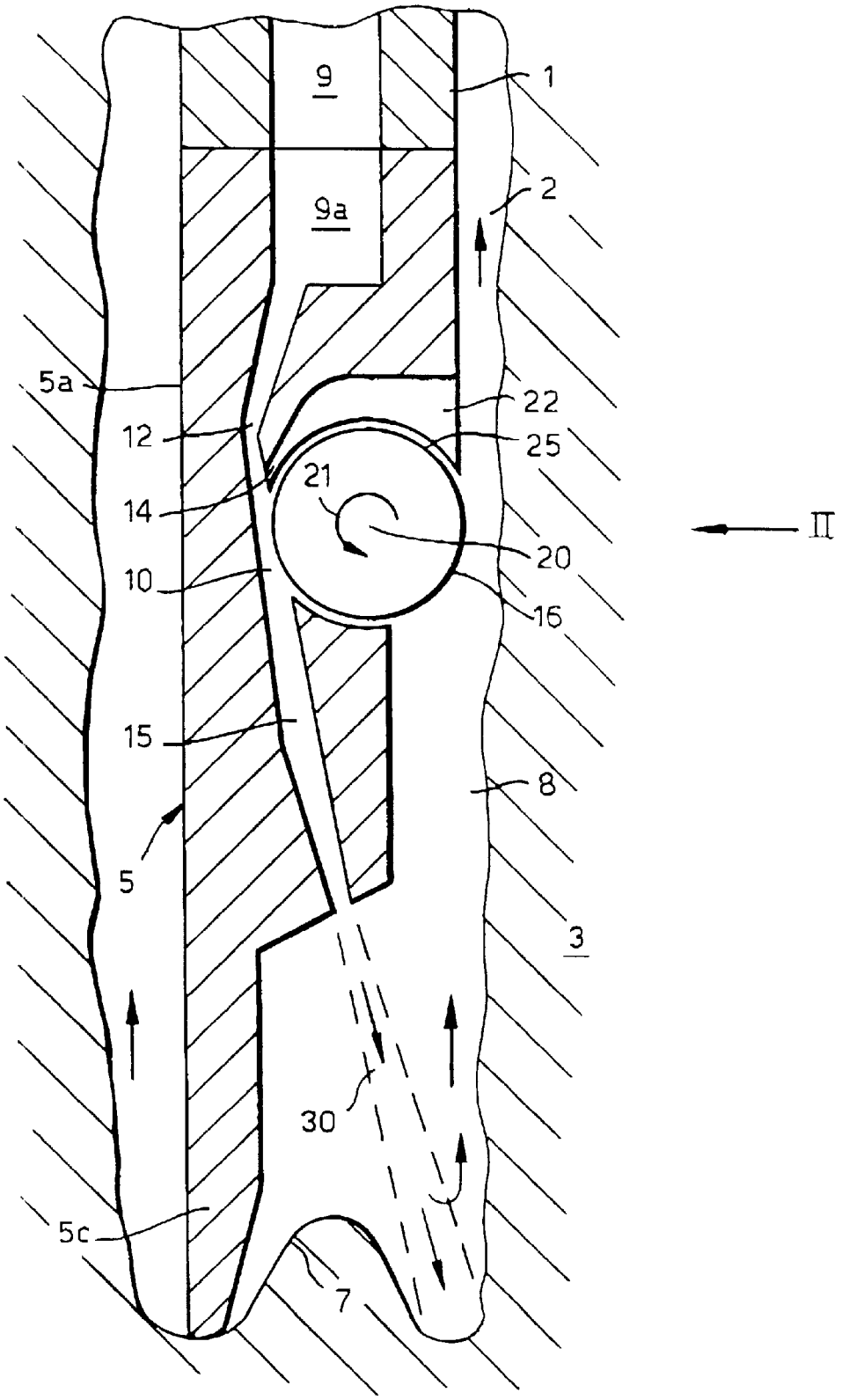

In the Figures, like reference numerals relate to like components.

In FIG. 1 is shown a drilling assembly including a drill string 1 extending into a borehole 2 formed in an earth formation 3 and a jetting device 5 arranged at the lower end of the drill string 1 near the bottom 7 of the borehole 2, whereby an annular space 8 is formed between the drilling assembly 1 and the wall of the borehole 2. The drill string 1 and the jetting device 5 are provided with a fluid passage 9, 9*a* for drilling fluid to be jetted against the borehole bottom as described below. The jetting device 5 has a body 5*a* provided with a mixing chamber 10 having a first inlet in the form of inlet nozzle 12 in fluid communication with the fluid passage 9, 9*a*, a second inlet 14 for abrasive particles and an outlet in the form of jetting nozzle 15 directed to the borehole bottom 7. The jetting device 5 is furthermore provided with an extension 5*c* in longitudinal direction of the drill string 1 to keep the jetting nozzle 15 at a selected distance from the borehole bottom 7.

Figure 2:
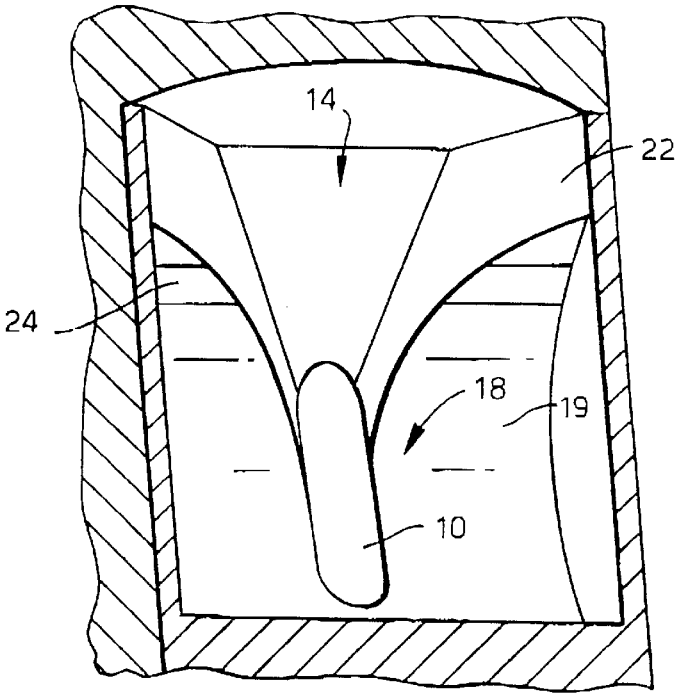
FIG. 2 schematically shows a detail in perspective view in direction II of FIG. 1.

As shown in FIG. 2 the body 5*a* is provided with a niche 18 having a semi-cylindrical side wall 19 and being in fluid communication with the mixing chamber 10 and with the second inlet 14. The niche 18 and the second inlet 14 are formed as a single recess in the body 5*a*. A rotatable cylinder 16 is arranged in the niche 18, the diameter of the cylinder being such that only a small clearance is present between the cylinder 16 and the side wall 19 of the niche 18 (in FIG. 2 the cylinder 16 has been removed for clarity purposes). The axis of rotation 20 of the cylinder 16 extends substantially perpendicular to the inlet nozzle 12. The second inlet 14 and the mixing chamber 10 each have a side wall formed by the outer surface of the cylinder 16. The second inlet 14 furthermore has guide elements in the form of opposite side walls 22, 24 which converge in inward direction to the mixing chamber 10 and which extend substantially perpendicular to side wall 19 of niche 18.

Figure 3:
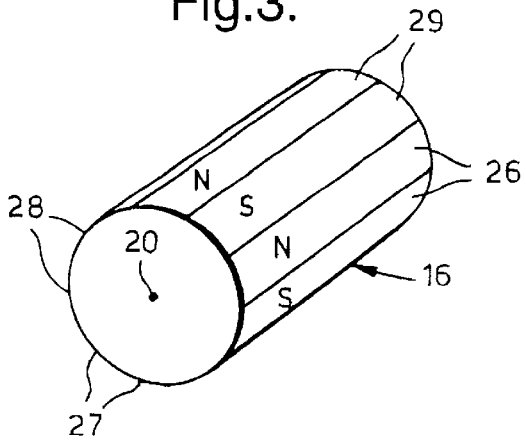
FIG. 3 schematically shows a component applied in the embodiment of FIG. 1.

As shown in FIG. 3 the outer surface of the cylinder 16 is provided with four magnets 26, 27, 28, 29, each magnet having two poles N, S extending in the form of polar bands in longitudinal direction of the cylinder 16. The magnets are made of a material containing rare earth elements such as Nd—Fe—B (e.g. $Nd_2Fe_{14}B$) or Sm—Co (e.g. $SmCoS_5$ or $Sm_2Co_{17}$) or Sm—Fe—N (e.g. $Sm_2Fe_{17}N_3$). Such magnets have a high magnetic energy density, a high resistance to demagnetisation and a high Curie temperature (which is the temperature above which an irreversible reduction of magnetism occurs).

During an initial phase of normal operation of the drilling assembly 1, a stream of a mixture of drilling fluid and a quantity of abrasive particles is pumped via the fluid passage 9, 9*a* and the inlet nozzle 12 into the mixing chamber 10. The abrasive particles contain a magnetically active material such as martensitic steel. Typical abrasive particles are martensitic steel shot or grit. The stream flows through the jetting nozzle 15 in the form of a jet stream 30 against the borehole bottom 7. After all abrasive particles have been pumped through the fluid passage 9, 9*a*, drilling fluid which is substantially free of abrasive particles is pumped through the passage 9, 9*a* and the inlet nozzle 12 into the mixing chamber 10.

By the impact of the jet stream 30 against the borehole bottom 7, rock particles are removed from the borehole bottom 7. The drill string 1 is simultaneously rotated so that the borehole bottom 7 is evenly eroded resulting in a gradual deepening of the borehole. The rock particles removed from the borehole bottom 7 are entrained in the stream which flows in upward direction through the annular space 8 and along the cylinder 16. The polar bands N, S of the cylinder 16 thereby are in contact with the stream flowing through the annular space 8 and induce a magnetic field into the stream. The magnetic field induces magnetic forces to the abrasive particles, which forces separate the abrasive particles from the stream and move the particles to the outer surface of the cylinder 16 to which the particles adhere. The cylinder 16 rotates in direction 21 firstly as a result of frictional forces exerted to the cylinder by the stream of drilling fluid flowing into the mixing chamber, and secondly as a result of frictional forces exerted to the cylinder by the stream flowing through the annular space 8. Thirdly, the high velocity flow of drilling fluid through the mixing chamber 10 generates a hydraulic pressure in the mixing chamber 10 significantly lower than the hydraulic pressure in the annular space 8. This pressure difference causes the fluid in niche 18 to be sucked in the direction of mixing chamber 10. The more abrasives particles are adhered to the surface of the cylinder 16 in this area the more effective the pressure difference is driving the rotation of the cylinder 16. Due to the rotation of the cylinder 16 the abrasive particles adhered to the outer surface of the cylinder 16 move through the second inlet 14 in the direction of the mixing chamber 10. The converging side walls 22, 24 of the second inlet 14 guide the abrasive particles into the mixing chamber 10. Upon arrival of the particles in the mixing chamber 10 the stream of drilling fluid ejected from the inlet nozzle 12 removes the abrasive particles from the outer surface of the cylinder 16 whereafter the particles are entrained into the stream of drilling fluid.

The remainder of the stream flowing through the annular space 8 is substantially free of abrasive particles and continues flowing upwardly to surface where the drill cuttings can be removed from the stream. After removal of the drill cuttings the drilling fluid is again pumped through the fluid passage 9, 9*a* and the inlet nozzle 12, into the mixing chamber 10 so that the cycle described above is repeated.

It is thus achieved that drilling fluid substantially free of abrasive particles circulates through the pumping equipment and the drilling assembly 1, while the abrasive particles circulate through the jetting device 5 only. Consequently the drill string 1, the borehole casing (if present) and the pumping equipment are not exposed to continuous contact with the abrasive particles and are thereby less susceptible of wear. Should an incidental loss of abrasive particles in the borehole occur, such loss can be compensated for by feeding new abrasive particles through the drill string.

Instead of applying a small clearance between the cylinder 16 and the side wall 19 of the niche 18, no such clearance can present. This has the advantage that the risk of abrasive particles becoming entrained between the cylinder 16 and the side wall 19, is reduced. However, to allow the cylinder 16 to rotate the contact surfaces of the cylinder 16 and the niche 18 then should be very smooth.

Figure 4:
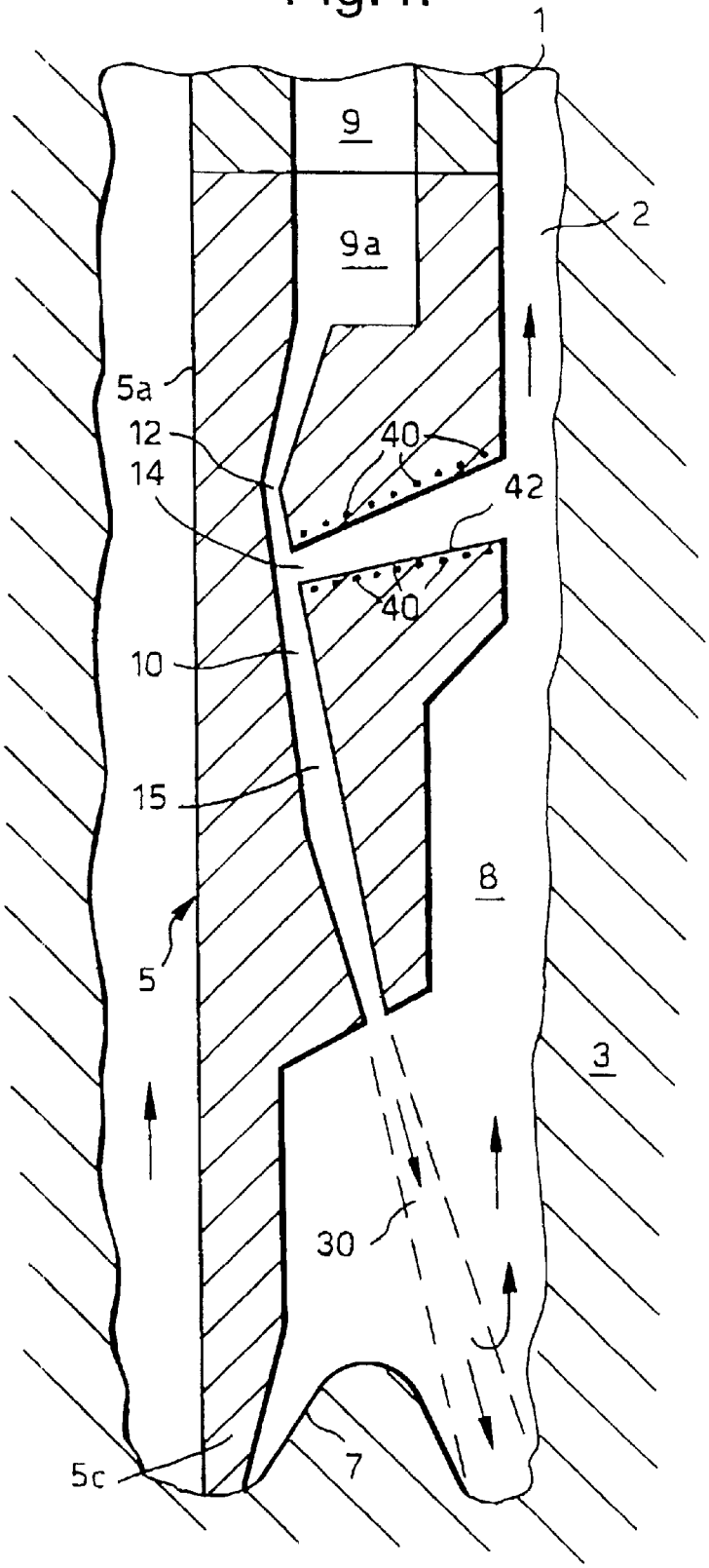
FIG. 4 schematically shows an alternative embodiment of the drilling assembly according to the invention.

Referring to FIG. 4 there is shown an alternative embodiment of the drilling assembly of the invention, wherein the means for creating a magnetic field in the stream is formed by an induction coil 40 wound around an inlet conduit 42 for abrasive particles. The inlet conduit 42 provides fluid communication between the annular space 8 and the mixing chamber 10, and converges in diameter in the direction from the annular space 8 to the mixing chamber 10.. The diameter of the induction coil converges correspondingly.

During normal use of the alternative embodiment of FIG. 4, an electric current is supplied to the induction coil 40 thereby creating a magnetic field having a field strength which increases in the conduit 42 in the direction from the annular space 8 to the mixing chamber 10. The abrasive particles are attracted by the magnetic field and are thereby separated from the stream flowing in the annular space 8. Under the effect of the magnetic field the abrasive particles flow into the inlet conduit 42. As a result of the increasing field strength in inward direction in the conduit 42, the abrasive particles move through the inlet conduit 42 to the mixing chamber 10. Upon arrival of the abrasive particles in the mixing chamber 10 they mix with the drilling fluid entering the mixing chamber through the fluid inlet nozzle 12, and a stream of abrasive particles and drilling fluid is ejected through the outlet nozzle 15 against the borehole bottom 7. From the borehole bottom 7, the stream flows in upward direction through the annular space. The flow cycle of the abrasive particles via the inlet conduit 42 is then repeated, while the fluid substantially free of abrasive particles continues flowing upwardly through the annular space 8 to surface where the drill cuttings are removed. The drilling fluid is again pumped through the fluid passage 9, 9*a* and the inlet nozzle 12, into the mixing chamber 10 where the fluid again mixes with the abrasive particles, etc.

Figure 5:
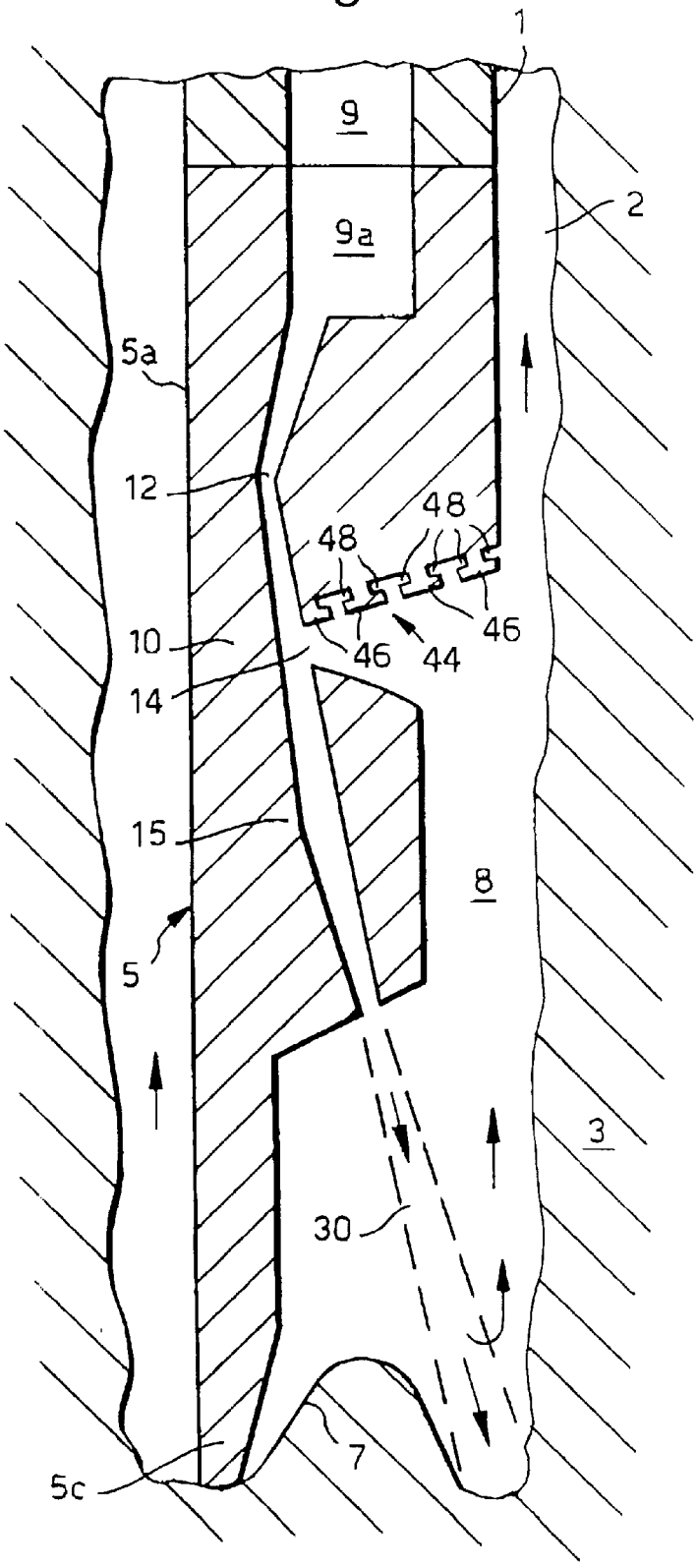
FIG. 5 schematically shows another alternative embodiment of the drilling assembly according to the invention.

In FIG. 5 is shown a further modification of the drilling assembly of the invention, wherein the means for creating a magnetic field in the stream is formed by a recirculation surface 44 extending from the annular space 8 to the abrasive particles inlet 14, and the means for creating the magnetic field is arranged to create a moving magnetic field so as to move the abrasive particles along the recirculation surface 44 to the abrasive particles inlet. This is achieved by application of a series of polar shoes 46 along the recirculation surface 44, each polar shoe 46 being provided with an induction coil 48.

During normal use the polar shoes 46 are connected to a multi-phase current source, for example a 3-phase current source in a manner similar to the polar shoes of a stator of a conventional brushless electric induction motor. As a result a magnetic field is created which moves along the recirculation surface 44 in the direction of the mixing chamber 10, thereby moving the abrasive particles along the surface 44 to the mixing chamber 10. Upon arrival in the mixing chamber 10 the abrasive particles mix with the drilling fluid entering the mixing chamber through the fluid inlet nozzle 12, and a stream of abrasive particles and drilling fluid is ejected through the outlet nozzle 15 against the borehole bottom 7. From the borehole bottom 7, the stream flows through the annular space 8 in upward direction. The flow cycle of the abrasive particles via the recirculation surface 44 is then repeated, while the fluid substantially free of abrasive particles continues flowing upwardly through the annular space 8 to surface where the drill cuttings are removed. The drilling fluid is again pumped through the fluid passage 9, 9*a* and the inlet nozzle 12, into the mixing chamber 10 where the fluid again mixes with the abrasive particles, etc.

It will be understood that many variations can be made to the above example without departing from the scope of the invention. For example, more than one inlet nozzle, mixing chamber or outlet nozzle can be applied. The profile of the borehole bottom, the dynamic stability of the jetting device, and the borehole wall structure can be influenced by varying the number and the orientation of the outlet nozzles. More than one rotatable cylinder can be applied, for example a second cylinder arranged on the other side of the mixing chamber and opposite the cylinder described above. Furthermore, the cylinder can be oriented differently, for example parallel to the longitudinal axis of the drilling assembly. Instead of the stream of drilling fluid causing rotation of the cylinder, the cylinder can for instance be rotated by an electric motor, a fluidic motor, or by generating a changing magnetic field which interacts with the magnetic poles of the cylinder. Instead of applying the cylinder, a rotatable member having a convex shape conforming to the curvature of the bore hole wall can be applied.

Instead of supplying the abrasive particles during the initial phase of normal operation via the fluid passage to the mixing chamber, the abrasive particles can be stored in a storage chamber formed in the jetting device and fed to the mixing chamber through a suitable conduit.

Furthermore, the assembly of the invention can be applied to cut a window in a borehole casing, to drill out a borehole packer, to perform a work-over operation or to remove scale or junk from a borehole.

The performance of the drilling assembly or the concentration of abrasive particles in the jet stream can be monitored by providing the jetting device with one or more of the following sensors:

- a sensor that detects mechanical contact between the jetting device and the hole bottom, e.g. including strain gauges or displacement sensors;
- an induction coil for monitoring rotation of the cylinder, which coil can, for example, be arranged in the niche or in another recess formed in the body of the jetting device;
- an acoustic sensor for monitoring sound waves in the annular space between the drill string and the borehole wall, caused by the jet stream impacting the hole bottom;
- an acoustic sensor for monitoring sound produced in the mixing chamber and the outlet nozzle and for providing information on the degree of wear of the mixing chamber and the outlet nozzle.

Instead of, or in addition to, separating the abrasive particles from the fluid by magnetic forces, the recirculation system can be provided with means for exerting centrifugal forces to the abrasive particles at the selected location. For instance, one or more hydrocyclones and/or one or more centrifuges can be applied in this respect, for example a plurality of hydrocyclones in series arrangement.

What is claimed is:

1. A drilling assembly for drilling a borehole into an earth formation, comprising:

a drill string extending into the borehole; and a jetting device arranged at a lower part of the drill string, the jetting device comprising:

a mixing chamber, comprising a first inlet in fluid communication with a drilling fluid supply conduit;

a second inlet to the mixing chamber for abrasive particles; and an outlet from the mixing chamber; and a jetting nozzle in fluid communication with the outlet and arranged to jet a stream of abrasive particles and drilling fluid against at least one of the borehole bottom and the borehole wall; and an abrasive particles recirculation system for separating the abrasive particles from the drilling fluid at a selected location where the stream flows from said at least one of the borehole bottom and the borehole wall towards an upper end of the borehole and for supplying the separated abrasive particles to the second inlet.

2. The drilling assembly of claim 1, wherein the recirculation system includes means for creating a magnetic field in the stream, and the abrasive particles include a material subjected to magnetic forces induced by the magnetic field, the magnetic field being oriented such that the abrasive particles are separated from the drilling fluid by said magnetic forces.

3. The drilling assembly of claim 2, wherein the recirculation system includes a recirculation surface extending from said selected location to the second inlet, and the means for creating the magnetic field is arranged to create a moving magnetic field which induces the abrasive particles to move along the recirculation surface to the second inlet.

4. The drilling assembly of claim 2, wherein the means for creating the magnetic field comprises at least one magnet.

5. The drilling assembly of claim 4, wherein each magnet is provided at a rotatable member having an outer surface extending between said selected location and the second inlet, the axis of rotation of the rotatable member being arranged so that during rotation of the member each magnet pole moves in the direction from said selected location to the second inlet, and wherein the recirculation system further includes means for rotating the rotatable member.

6. The drilling assembly of claim 5, wherein the means for rotating the rotatable member includes a nozzle formed by the first inlet.

7. The drilling assembly of claim 5, wherein the jetting device is provided with at least one guide element extending along the outer surface of the rotatable member and at a selected angle to the axis of rotation of the rotatable member so as to guide the abrasive particles adhered to said outer surface to the second inlet.

8. The drilling assembly of claim 5, wherein the poles of each magnet extend substantially parallel to the axis of rotation of the rotatable member.

9. The drilling assembly of claim 5, wherein an annular space is formed between the drilling assembly and the borehole wall, and wherein said selected location where the abrasive particles are separated from the drilling fluid is in the annular space.

10. The drilling assembly of claim 9, wherein the shape of the rotatable member is selected from a cylindrical shape and a convex shape conforming to the curvature of the borehole wall in the vicinity of the rotatable member.

11. The drilling assembly of claim 2, wherein said material subjected to magnetic forces comprises at least one of a ferromagnetic, a ferrimagnetic and a paramagnetic material.

12. The drilling assembly of claim 1, wherein the recirculation system includes means for separating the abrasive particles from the drilling fluid by centrifugal forces exerted to the particles.

13. The drilling assembly of claim 1, wherein the drill string is at a lower end thereof provided with a drill bit, and the jetting nozzle is arranged to jet the stream of abrasive particles and drilling fluid against the wall of the borehole as drilled by the drill bit so as to enlarge the borehole diameter to a diameter significantly larger than an outer diameter of the drill bit.

14. The drilling assembly of claim 13, wherein the drill string has an inner diameter larger than the outer diameter of the drill bit, the drill bit being detachable from the drill string and being provided with means for detaching the drill bit from the drill string and for retrieving the drill bit through the drill string to surface.

15. A drilling assembly for drilling a borehole into an earth formation, comprising a drill string extending into the borehole and a jetting device arranged at a lower part of the drill string, the jetting device being provided with a mixing chamber having a first inlet in fluid communication with a drilling fluid supply conduit, a second inlet for abrasive particles and an outlet which is in fluid communication with a jetting nozzle arranged to jet a stream of abrasive particles and drilling fluid against at least one of the borehole bottom and the borehole wall, the jetting device further being provided with an abrasive particles recirculation system for separating the abrasive particles from the drilling fluid at a selected location where the stream flows from said at least one of the borehole bottom and the borehole wall towards an upper end of the borehole and for supplying the separated abrasive particles to the second inlet.

16. The drilling assembly of claim 15, wherein the recirculation system includes means for creating a magnetic field in the stream, and the abrasive particles include a material subjected to magnetic forces induced by the magnetic field, the magnetic field being oriented such that the abrasive particles are separated from the drilling fluid by said magnetic forces.

17. The drilling assembly of claim 16, wherein the recirculation system includes a recirculation surface extending from said selected location to the second inlet, and the means for creating the magnetic field is arranged to create a moving magnetic field which induces the abrasive particles to move along the recirculation surface to the second inlet.

18. The drilling assembly of claim 17, wherein the means for creating the magnetic field comprises at least one magnet.

19. The drilling assembly of claim 18, wherein each magnet is provided at a rotatable member having an outer surface extending between said selected location and the second inlet, the axis of rotation of the rotatable member being arranged so that during rotation of the member each magnet pole moves in the direction from said selected location to the second inlet, and wherein the recirculation system further includes means for rotating the rotatable member.

20. The drilling assembly of claim 19, wherein the means for rotating the rotatable member includes a nozzle formed by the first inlet.

21. The drilling assembly of claim 20, wherein the jetting device is provided with at least one guide element extending along the outer surface of the rotatable member and at a selected angle to the axis of rotation of the rotatable member so as to guide the abrasive particles adhered to said outer surface to the second inlet.

22. The drilling assembly of claim 21, wherein the poles of each magnet extend substantially parallel to the axis of rotation of the rotatable member.

23. The drilling assembly of claim 22, wherein an annular space is formed between the drilling assembly and the borehole wall, and wherein said selected location where the abrasive particles are separated from the drilling fluid is in the annular space.

24. The drilling assembly of claim 23, wherein the shape of the rotatable member is selected from a cylindrical shape and a convex shape conforming to the curvature of the borehole wall in the vicinity of the rotatable member.

25. The drilling assembly of claim 24, wherein said material subjected to magnetic forces comprises at least one of a ferromagnetic, a ferrimagnetic and a paramagnetic material.

26. The drilling assembly of claim 25, wherein the recirculation system includes means for separating the abrasive particles from the drilling fluid by centrifugal forces exerted to the particles.

27. The drilling assembly of claim 26, wherein the drill string is at a lower end thereof provided with a drill bit, and the jetting nozzle is arranged to jet the stream of abrasive particles and drilling fluid against the wall of the borehole as drilled by the drill bit so as to enlarge the borehole diameter to a diameter significantly larger than an outer diameter of the drill bit.

28. The drilling assembly of claim 27, wherein the drill string has an inner diameter larger than the outer diameter of the drill bit, the drill bit being detachable from the drill string and being provided with means for detaching the drill bit from the drill string and for retrieving the drill bit through the drill string to surface.

* * * * *